US006992635B2

(12) United States Patent
Nishiyama et al.

(10) Patent No.: US 6,992,635 B2
(45) Date of Patent: Jan. 31, 2006

(54) MICROSTRIP LINE TYPE PLANAR ARRAY ANTENNA

(75) Inventors: Eisuke Nishiyama, Saga (JP); Masayoshi Aikawa, Saga (JP); Fumio Asamura, Saitama (JP); Takeo Oita, Saitama (JP)

(73) Assignees: Nihon Dempa Kogyo Co., Ltd., Tokyo (JP); Saga University, Saga (JP)

( * ) Notice: Subject to any disclaimer, the term of this patent is extended or adjusted under 35 U.S.C. 154(b) by 0 days.

(21) Appl. No.: 11/046,550

(22) Filed: Jan. 28, 2005

(65) Prior Publication Data

US 2005/0264450 A1 Dec. 1, 2005

(30) Foreign Application Priority Data

Jan. 28, 2004 (JP) ..... 2004-020576
Jan. 27, 2005 (JP) ..... 2005-020449

(51) Int. Cl.
*H01Q 1/38* (2006.01)

(52) U.S. Cl. ..... 343/700 MS; 343/846

(58) Field of Classification Search ..... 343/700 MS, 343/846, 848, 834; H01Q 1/38
See application file for complete search history.

(56) References Cited

U.S. PATENT DOCUMENTS 5,121,929 A * 6/1992 Cobb ..... 277/317
5,382,959 A * 1/1995 Pett et al. ..... 343/700 MS
6,061,027 A * 5/2000 Legay et al. ..... 343/700 MS
2004/0041732 A1 3/2004 Aikawa et al.

FOREIGN PATENT DOCUMENTS

JP 2003-115717 4/2003
JP 2004-328067 11/2004

* cited by examiner

*Primary Examiner*—Hoanganh Le
(74) *Attorney, Agent, or Firm*—Katten Muchin Rosenman LLP

(57) ABSTRACT

A planar array antenna comprises a powered antenna element and an adjacent passive element which are microstrip-line type ones and disposed on one principal surface of a dielectric substrate; and a feeding system for feeding high frequency power to the powered antenna element. The powered antenna element and a passive element disposed ahead of the powered antenna element constitute a powered element pair, and the adjacent passive element and a passive antenna element disposed ahead of the adjacent passive element constitute a passive element pair. The passive element pair is disposed so that it adjoins said powered element pair in an electric field direction or a magnetic field direction of radio wave emitted from the powered antenna element.

15 Claims, 13 Drawing Sheets

MICROSTRIP LINE TYPE PLANAR ARRAY ANTENNA

BACKGROUND OF THE INVENTION

1. Technical Field of the Invention

The present invention relates to a planar array antenna having microstrip-line antenna elements, which is primarily applied in millimeter wave and microwave bands, and more particularly to a planar array antenna which has an improved high antenna gain and maintains a wide bandwidth.

2. Description of the Related Art

With the developments in radio communication technologies, especially mobile communications, antennas are required to be of higher performance and smaller size. Planar antennas are widely used in millimeter wave and microwave bands. Planar antennas are generally grouped into microstrip-line antennas and slot-line antennas. Of these planar antennas, microstrip-line planar antennas are small in size and can easily be manufactured, and has a feature that it can be produced at low cost and the like. However, since microstrip-line planar antennas have a relatively low antenna gain, it has been customary to construct a microstrip-line planar array antenna using a plurality of the antenna elements. The present inventors have already proposed in Japanese Patent Laid-open Application No. 2003-115717 (JP, P2003-115717A), a planar array antenna which can facilitate impedance mating in a feeding system for a plurality of antenna elements of microstrip-line type and remarkably simplify the constitution of the feeding system.

FIG. 1A is a plan view of a conventional microstrip-line planar array antenna in which the number of antenna elements which are fed is four, and FIG. 1B a cross-sectional view taken along line A—A of FIG. 1A.

On one principal surface of substrate 1 which is made of a dielectric material, antenna elements 2*a* to 2*d* each of which is constructed by a square conductor and a feeding system which supplies RF power to the antenna elements 2*a* to 2*d*. Each of antenna elements 2*a* to 2*d* is an antenna element of a microstrip-line type, and these antenna elements are arranged in a quadruplet manner. The centers of antenna elements 2*a* to 2*d* are disposed on the position of apexes of a geometric square, for example, apexes of a certain regular square. Ground conductor 4 is formed on an almost entire surface of the other principal surface of substrate 1. In the example shown here, the antenna elements are arranged in a matrix in two horizontal rows and two vertical columns.

The feeding system comprises microstrip line 3*a* which is formed, as a first feeding line, on one principal surface of substrate 1, slot line 3*b* which is formed, as a second feeding line, on the ground conductor in the other principal surface of substrate 1, and microstrip line 3*c* which is formed, as a third feeding line, on one principal surface of substrate 1.

Microstrip line (i.e., the first feeding line) 3*a* connects antenna elements disposed adjacent in the right and left direction. Among two microstrip lines 3*a*, both ends of upper microstrip line 3*a* are connected to antenna elements 2*a*, 2*b*, respectively. Similarly, both ends of lower microstrip line 3*a* are connected to antenna element 2*c*, 2*d*. Slot line (i.e., the second feeding line) 3*b* both ends which traverse two microstrip lines 3*a* at the proximity of midpoints of these microstrip lines 3*a* and are electromagnetically coupled to microstrip lines 3*a*. Microstrip line (i.e., the third feeding line) 3*c* extends from the feeding end T disposed at the left end of substrate 1, and the tip end of microstrip line 3*c* traverses the mid point of slot line 3*b* and is electromagnetically coupled to slot line 3*b*.

In this case, with the wavelength corresponding to antenna frequency (i.e., resonant frequency) taken as λ, the both ends of slot line 3*b* extend approximately λ/4 in length from the traversing points with upper and lower microstrip lines 3*a* and become electrically open ends for the resonant frequency component seen from the traversing points. Similarly, the tip end of microstrip line 3*c* extends approximately λ/4 in length from the traversing point with slot line 3*b* and becomes electrically an electrically short-circuited end for the resonant frequency component seen from the traversing point.

Explanations will be made for the case of transmission, for example. In such an array antenna, as electric field E illustrated by a arrow mark and a mark indicating the direction against the substrate plane, high frequency power P from feeding end T of microstrip line 3*c* is first propagated to slot line 3*b* and then it branches in-phase upper and lower directions on slot line 3*b* from the midpoint of slot line 3*b*. That is, the high frequency power branches in-phase from microstrip line 3*c* to slot line 3*b*. High frequency power P is then propagated to microstrip line 3*a* from the end portion of slot line 3*b*, and it branches in opposite phase in left and right directions on microstrip line 3*a* from the midpoint of microstrip line 3*a*. Each of antenna elements 2*a* to 2*d* is thus fed through microstrip line 3*c*, slot line 3*b* and microstrip line 3*a*. In the following description, an antenna element which is connected to an end of a feeding line of a microstrip line type to be fed with the high frequency power is referred to as a powered antenna element. Consequently, antenna elements 2*a* to 2*d* are powered antenna elements.

As obvious from the figure, since the feeding positions on powered antenna elements 2*a*, 2*c*, that is, the connecting positions of microstrip strip lines 3*a* have a mirror symmetric relation to the feeding positions on powered antenna elements 2*b*, 2*d*, each of antenna elements 2*a* to 2*d* is excited in-phase. Radio waves having the same polarization plane are emitted from respective antenna elements 2*a* to 2*d* in the perpendicular direction and these radio waves are combined. In this case, the electric field plane direction of the radio wave is in the feeding direction of the high frequency power and the magnetic field plane direction is perpendicular to the electric field plane direction. Of course, in the case of reception, this array antenna operates in the same manner as described above.

By comparing one in which the feeding system is arranged with only microstrip lines, this array antenna has a simple configuration for impedance matching and the feeding system of a simple structure. Further, with a configuration in which four antenna elements are arranged in the above manner taken as a basic unit, an array antenna having more number of the powered antenna elements can be configured by combining a plurality of the basic units.

For example, with the four-element array antenna described above taken as the basic unit, an eight-element array antenna can be constructed as shown in FIG. 2A by arranging two pieces of the basic units in mirror symmetry (or point symmetry) around feeding ends T of these basic units as a center, connecting microstrip lines 3*c* of the two basic units to each other, and electromagnetically coupling slot line 3*d* as a fourth feeding line to the midpoint of the common-connected microstrip line 3*c*.

Further, a 16-element array antenna is constructed as shown in FIG. 2B by preparing two pieces of the eight-element array antennas shown in FIG. 2A, arranging two pieces of the eight-element array antennas in mirror symmetry (or point symmetry) around the feeding ends thereof as a center, connecting slot lines 3*d* to each other, and electromagnetically coupling microstrip line 3*e* as a fifth feeding line to the midpoint of the common-connected slot line 3*d*. The 16-element array antenna shown in FIG. 2B is provided with four pieces of the basic units described above.

An array antenna having further number of antenna elements can be constructed by combining array antennas in the above manner. Specifically, n being integer larger than or equal to 3, an array antenna having $2^{n+1}$ pieces of antenna elements is constructed by arranging two pieces of $2^n$-element array antennas in mirror symmetry or point symmetry around a feeding end of the (n+1)-th feeding line as a center, connecting the (n+1)-th feeding lines of the $2^n$-array antennas to each other, and providing an (n+2)-th feeding line which traverses a midpoint of the common-connected (n+1)-th feeding line and is electromagnetically coupled to the common-connected (n+1)-th feeding line. In this $2^{n+1}$-element array antenna, $2^{n-1}$-pieces of the basic units describe above are included. It should be noted that an n-th feeding line is a microstrip line where n is an odd number and the n-th feeding line is a slot line when n is an even number.

The planar array antenna described above has, however, an disadvantage that it basically has a narrow frequency band width because each powered antenna element is an antenna element of a microstrip line type. Therefore, it is proposed in Japanese Patent Laid-open Application No. 2004-328067 (JP, P2004-328067A) to widen the band width of frequency characteristics of the antenna by disposing a passive element ahead of the powered antenna element. FIGS. 3A to 3C illustrate a microstrip line planar array antenna whose frequency band is widen by loading a passive element to each powered antenna element. The passive element means an antenna element of a microstrip line type which consists of a conductor just like the powered antenna element but is not directly connected to a feeding line. The passive element is excited through the electromagnetic coupling with the powered antenna element and emits electromagnetic wave.

The array antenna shown in FIGS. 3A to 3C is one in which passive antenna elements 6*a* to 6*d* are loaded to the four-element array antenna shown in FIGS. 1A to 1C. FIG. 3A is a plan view illustrating an intermediate layer in the array antenna, FIG. 3B is a plan view of the array antenna, and FIG. 3C is a cross-sectional view taken along line A—A of FIG. 3A.

Powered antenna elements 2*a* to 2*d* are disposed on one principal surface of a first substrate which consists of a dielectric material, and ground conductor 4 is arranged on the other principal surface of the first substrate. Second substrate 1*b* which consists of a dielectric material is laminated on the one principal surface of first substrate 1*a* so that second substrate 1*b* covers antenna elements 2*a* to 2*d*. Multilayer substrate 5 is constituted from first substrate 1*a* and second substrate 1*b*. Antenna elements 2*a* to 2*d* are sandwiched and disposed between first and second substrates 1*a*, 1 *b*, and the plane in which antenna elements 2*a* to 2*d* are formed is referred to as an intermediate layer. The arrangement of the feeding system for antenna elements 2*a* to 2*d* is identical to that shown in FIGS. 1A and 1B.

On the surface of second substrate 1*b*, passive elements 6*a* to 6*d* which are not connected to the feeding system are disposed at the position ahead of powered antenna elements 2*a* to 2*d* which are disposed on the intermediate layer so that passive elements 6*a* to 6*d* oppose to powered antenna elements 2*a* to 2*d*, respectively. It should be noted that a pair of a powered antenna element and a passive element corresponding to the powered antenna element is referred to as a powered element pair. Therefore, the antenna illustrated in the figure is provided with four sets of powered element pairs 26*a* to 26*d*. The frequency band of a microstrip line planar array antenna is widen by arranging a passive element ahead of each powered antenna element in this manner. However, in this configuration, as the number of the antenna elements is increased for improving the antenna gain, the number of the basic units described above is also increased. It is required to supply more high frequency power to the antenna.

SUMMARY OF THE INVENTION

It is therefore an object of the present invention to provide a planar array antenna of a microstrip line type which can reduce the number of powered antenna elements and has an improved antenna gain.

The above object can be achieved by a planar array antenna comprising a substrate made of a dielectric material, a powered antenna element of a microstrip-line type disposed on one principal surface of the substrate, a ground conductor disposed on the other principal surface of the substrate, a feeding system for feeding high frequency power to the powered antenna element, an adjacent passive element disposed on the one principal surface of the substrate, a first passive element disposed ahead of the powered antenna element with space therebetween; and a second passive element disposed ahead of the adjacent passive element with space therebetween, wherein the powered antenna element and a first passive element corresponding to the powered antenna element constitute a powered element pair, the adjacent passive element and a second passive element corresponding to the adjacent passive element constitute a passive element pair, and the passive element pair is disposed so that it adjoins the powered element pair in an electric field direction or a magnetic field direction on electromagnetic wave emitted from the powered antenna element.

Since the powered element pair in which the powered antenna element and the first passive element oppose to each other via the dielectric substrate and the passive element pair in which the adjacent antenna element and the second first passive element oppose to each other via the dielectric substrate with the same condition adjoin to each other in the array antenna according to the present invention, the powered element pair and the passive element pair are easily electromagnetically coupled to each other. For example, the passive element pair easily receives the leak electromagnetic field from the powered element pair and both pairs are electromagnetically coupled to each other easily. Since the passive element pair is disposed in an electric field plane direction or a magnetic field direction of the electromagnetic wave emitted from the powered element pair, the powered element pair and the passive element pair electromagnetically couple to each other directly. As a result, the passive element also emits the electromagnetic wave with increased electromagnetic field intensity at the antenna frequency. Then the electromagnetic waves from the powered element pair and the passive element pair are combined and emitted. As a result, a planar array antenna having an antenna gain equivalent to that of a conventional array antenna in which all antenna elements are powered antenna elements is obtained. According to the present invention, it is possible to reduce the number of powered antenna elements to which high frequency power is supplied while improving the antenna gain.

In the present invention, it is preferable to construct a basic unit by two sets of the powered element pairs and a plurality sets of the passive element pairs. It is preferable to provide, in the basic unit, a first feeding line consisting of a microstrip-line which connects at both ends thereof to two powered antenna elements, and a second feeding line consisting of a slot line formed in said ground conductor, the second feeding line traversing a midpoint of the first feeding line and electromagnetically coupled to the first feeding line. In this case, the high frequency power from a feeding end of the second feeding line branches in opposite phase to opposing directions in the electric field from the midpoint of the first feeding line, and then is supplied to two powered antenna elements. As a result, the two powered antenna elements are excited in-phase and emits electromagnetic wave with the same polarization plane. Therefore, by utilizing the above basic units, impedance matching in the feeding system is facilitated and the structure of the feeding system is simplified.

According to the present invention, it is possible to easily construct an planar array antenna with numbers of elements by using a plurality pieces of the basic units described above and combining an opposite-phase branch to a microstrip line from a slot line and an in-phase branch to a slot lint from a microstrip line to configure the feeding system. In such a multi-element planar array antenna, it is possible to improve the antenna gain while suppress the increase in the number of the powered antenna elements.

DETAILED DESCRIPTION OF THE PREFERRED EMBODIMENTS

The microstrip line type planar array antenna according to the present invention uses basic units each comprising two pieces of powered antenna elements and is configured that a plurality of the basic units are fed with high frequency power using a feeding system which consists of a microstrip line and a slot line. In the basic unit, the powered antenna elements are connected to both ends, respectively, of a microstrip line which is a first feeding line. A passive element (i.e., a first passive element) is disposed ahead of the powered antenna element to constitute the powered element pair described above. Further, the basic unit comprises a passive element (i.e., an adjacent passive element) disposed in a plane in which the powered antenna element is disposed, and a passive element (i.e., a second passive element) disposed ahead of the adjacent passive element. The adjacent passive element adjoins the powered antenna element. The pair consisting of the adjacent passive element and the passive element ahead of the adjacent passive element is referred to as a passive element pair. The adjacent passive element adjoins the powered antenna element in an electric field direction or a magnetic field direction of the electromagnetic wave emitted from the powered antenna element.

There are various types of the arrangement of the powered element pairs and the passive element pairs in a basic unit.

For example, among four apexes of a regular square or rectangle, the powered element pairs may be disposed on two apexes sharing one side and the passive element pairs may be disposed on the two remaining apexes. Alternatively, among four apexes of a regular square or rectangle, the powered element pairs may be disposed on two apexes which share one diagonal and the passive element pairs may be disposed on the two remaining apexes. Further, among the lattice points arranged by 2×3 in an orthogonal grid, the powered element pairs may be disposed on two center lattice points and the passive element pairs may be disposed on the four remaining lattice points.

In either case, each basic unit is configured that the passive elements are disposed ahead of the powered antenna element and adjacent passive element by using the multilayer substrate.

Figure 1A:
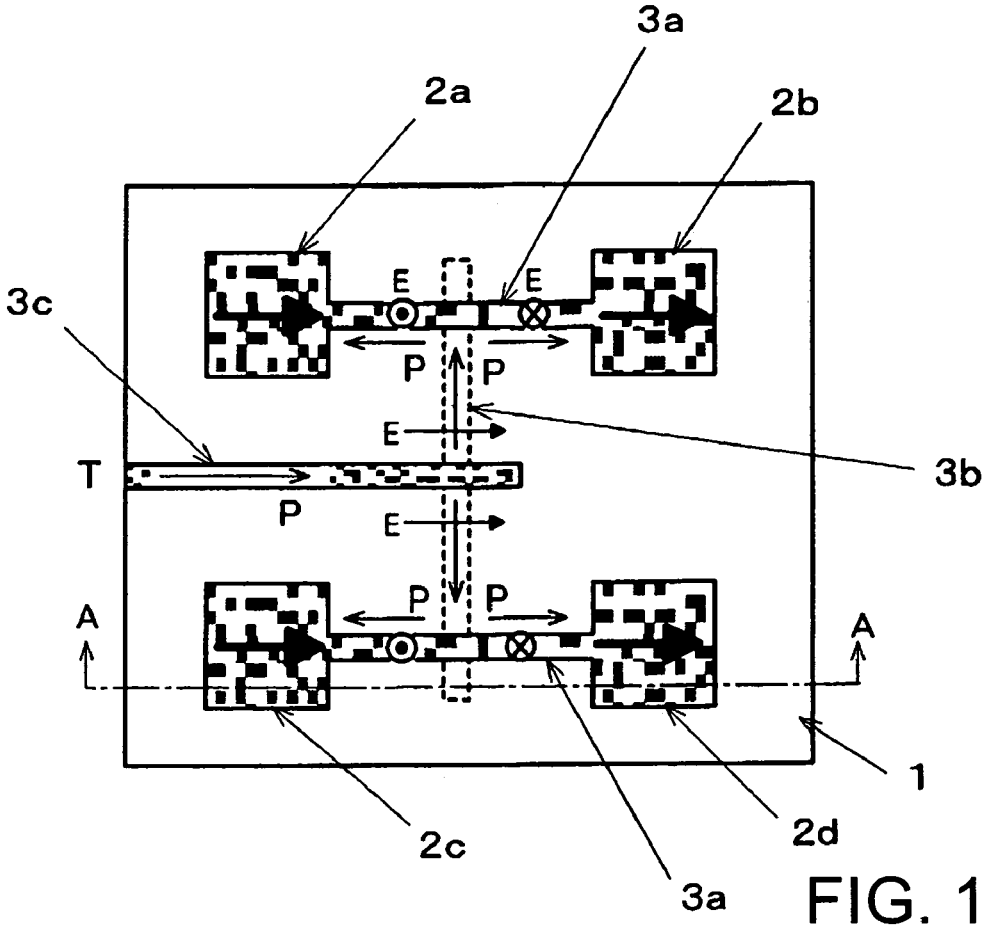
FIG. 1A (BACKGROUND ART)
FIG. 1A is a plan view illustrating a conventional four-element planar array antenna having microstrip-line antenna elements.
Figure 1B:
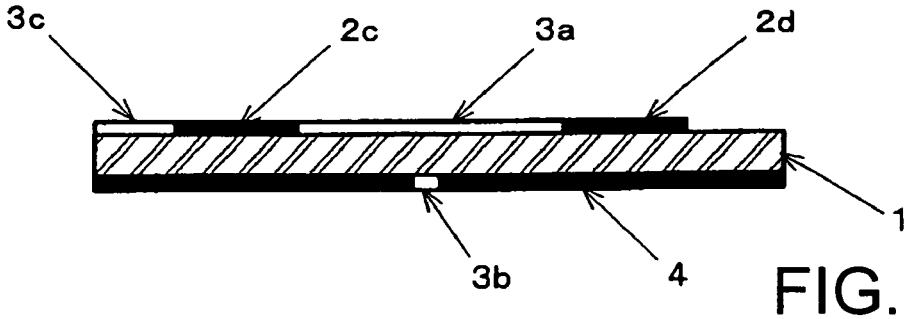
FIG. 1B (BACKGROUND ART)
FIG. 1B is a cross-sectional view taken along line A—A of FIG. 1A.
Figure 2A:
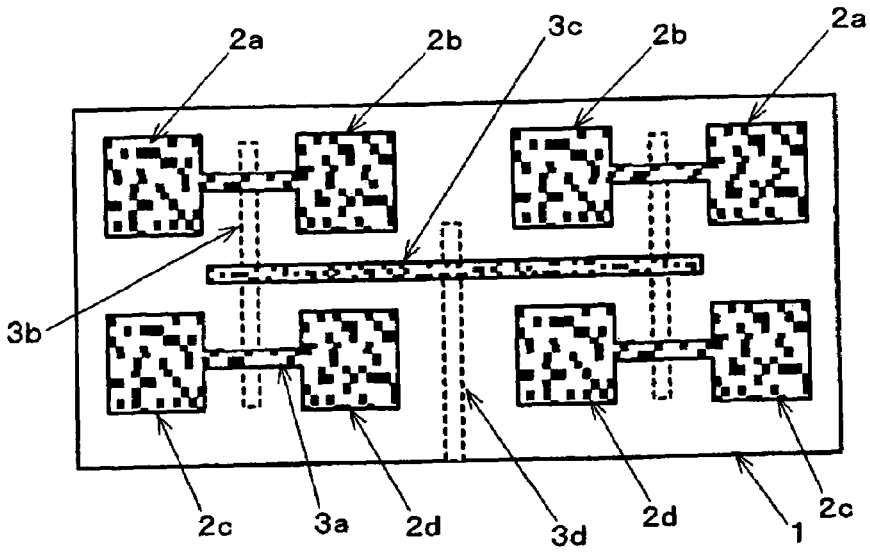
FIG. 2A (BACKGROUND ART)
FIG. 2A is a plan view illustrating a conventional eight-element planar array antenna.
Figure 2B:
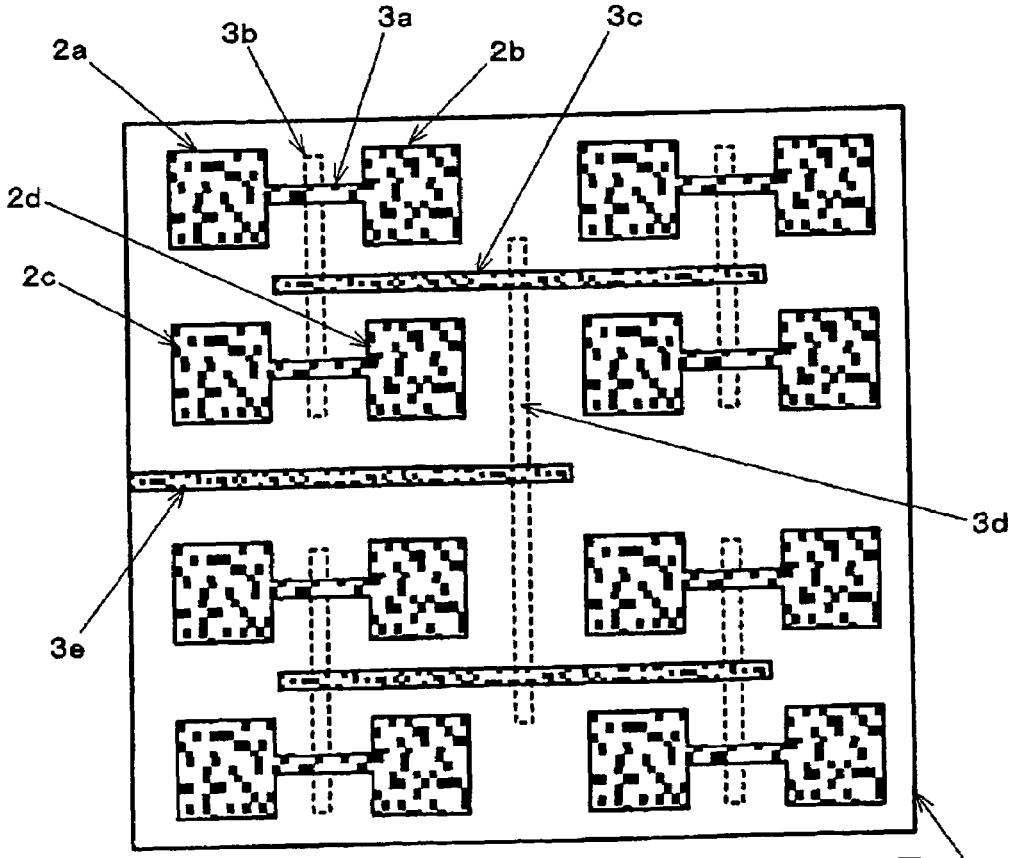
FIG. 2B (BACKGROUND ART)
FIG. 2B is a plan view illustrating a conventional 16-element planar array antenna.
Figure 3A:
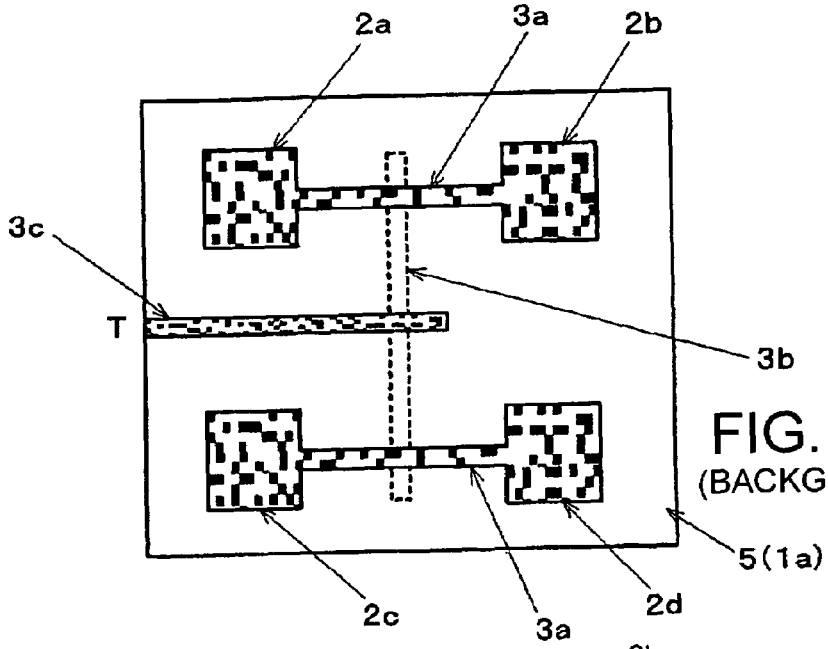
FIG. 3A (BACKGROUND ART)
FIG. 3A is a plan view illustrating an intermediate layer in a conventional microstrip-line planar array antenna.
Figure 3B:
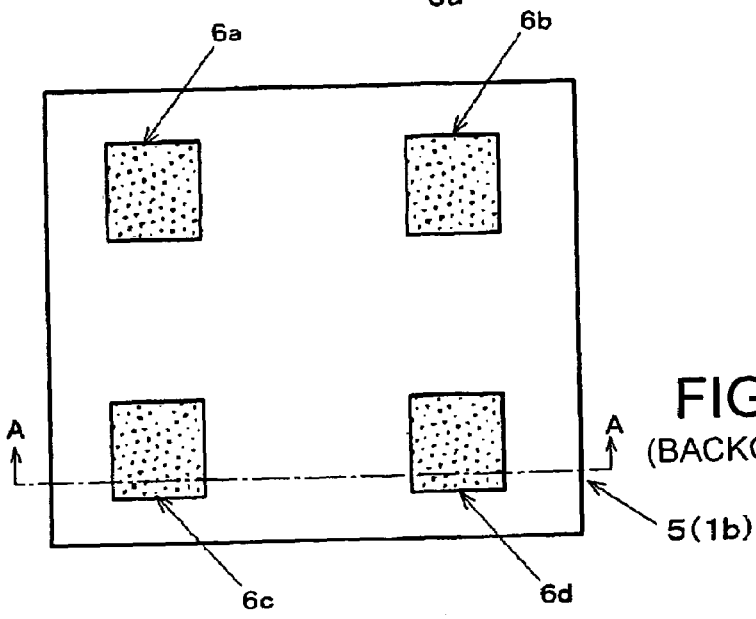
FIG. 3B (BACKGROUND ART)
FIG. 3B is a plan view of the planar array antenna shown in FIG. 3A.
Figure 3C:
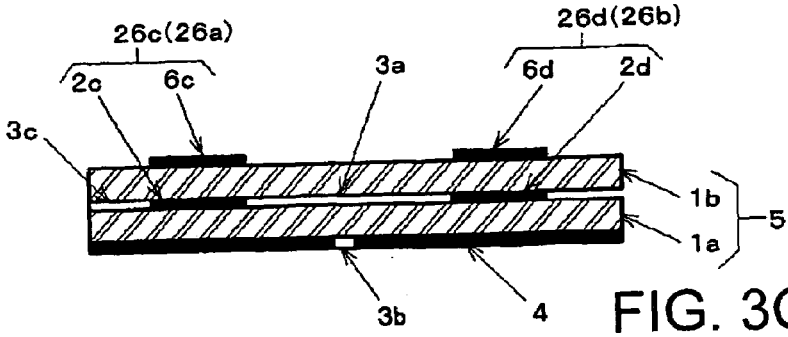
FIG. 3C (BACKGROUND ART)
FIG. 3C is a cross-sectional view taken along line A—A of FIG. 3B.
Figure 4A:
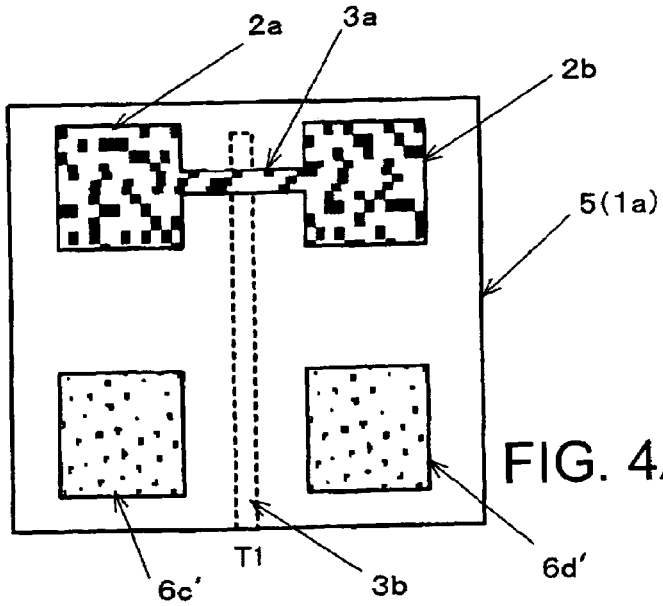
FIG. 4A is a plan view illustrating an intermediate layer of a basic unit which constitutes a planar array antenna according to a first embodiment of the present invention.
Figure 4B:
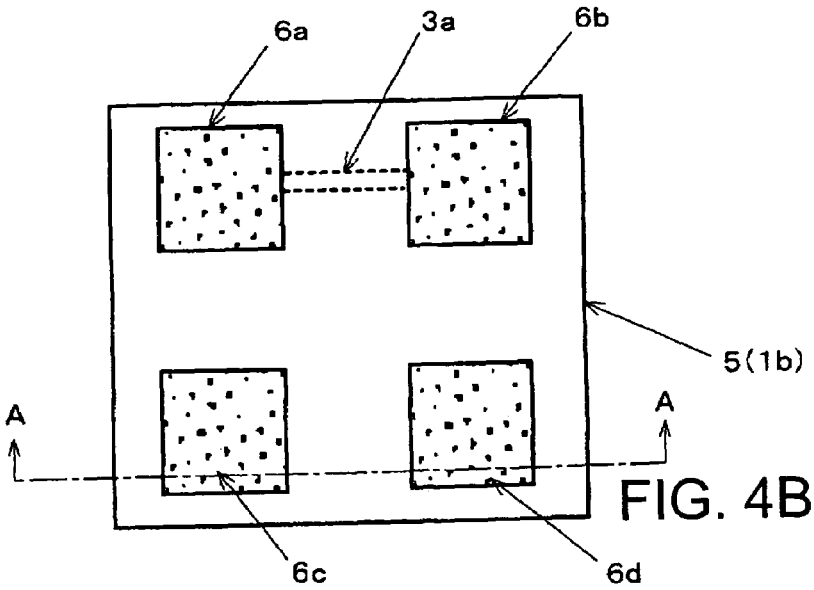
FIG. 4B is a plan view of the basic unit shown in FIG. 4A.
Figure 4C:
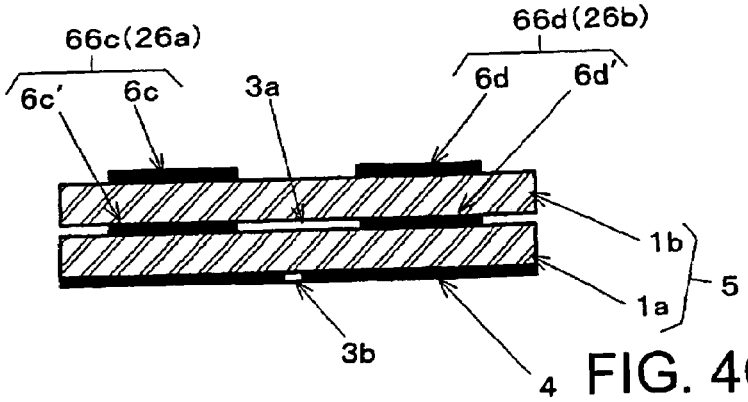
FIG. 4C is a cross-sectional view taken along line A—A of FIG. 4B.

FIGS. 4A to 4C illustrate a microstrip line type planar array antenna according to the first embodiment of the present invention and show the construction of the basic unit used in this planar array antenna. It should be noted that, in FIGS. 4A to 4C, those parts which are identical to those shown in FIGS. 1A to 1C are denoted by identical reference characters and the duplicate explanations thereon are simplified.

In the basic unit shown in FIGS. 4A to 4C, first and second substrates 1*a*, 1*b* each consisted of a dielectric material are stacked and constitutes multilayer substrate 5. On the plane sandwiched by first substrate 1*a* and second substrate 1*b*, that is, an intermediate layer, two pieces of powered antenna elements 2*a*, 2*b* are arranged at the positions corresponding to the both ends of one side of a geometric square, for example, a regular square, and two pieces of adjacent passive element 6*c*', 6*d*' are arranged at the two remaining apexes of the regular square. In the example shown in the figures, powered antenna elements 2*a*, 2*b* are disposed on the upper side and adjacent passive elements 6*c*', 6*d*' are disposed on the lower side. Each of the powered antenna elements and adjacent passive elements is formed by a substantially square conductor. On the surface of second substrate 1*b*, passive elements 6*a*, 6*b*, 6*c*, 6*d* each consisted of a substantially square conductor are arranged at the positions just above the powered antenna elements 2*a*, 2*b* and adjacent passive elements 6*c*', 6*d*' so that passive elements 6*a*, 6*b*, 6*c*, 6*d* oppose to the powered antenna elements and the adjacent passive elements.

Powered elements pairs 26*a*, 26*b* are thus formed by powered antenna elements 2*a*, 2*b* in the intermediate layer and passive elements 6*a*, 6*b* on the surface, and passive element pairs 66*c*, 66*d* are formed by adjacent passive antenna elements 6*c*', 6*d*' in the intermediate layer and passive elements 6*c*, 6*d* on the surface. Here, the distance between the element in the intermediate layer and the element on the surface in each element pair 26*a*, 26*b* 66*c*, 66*d* is equal to the thickness of second substrate 1*b* and identical to each other.

The feeding system of such a basic unit comprises microstrip line 3*a*, which is a first feeding line, and slot line 3*b*, which is a second feeding line. Microstrip line 3*a* is arranged in the intermediate layer of multilayer substrate 5 and connects powered antenna elements 2*a*, 2*b*. Slot line 3*b* is formed in ground conductor 4 which is provided on the reverse surface of multilayer substrate 5 and extends from feeding end T1 which is provided at the lower side in the figure. The tip end of slot line 3*b* traverses the midpoint of microstrip line 3*a*. In this case, slot line 3 passes through the region between passive element pairs 66*c*, 66*d*.

Figure 5:
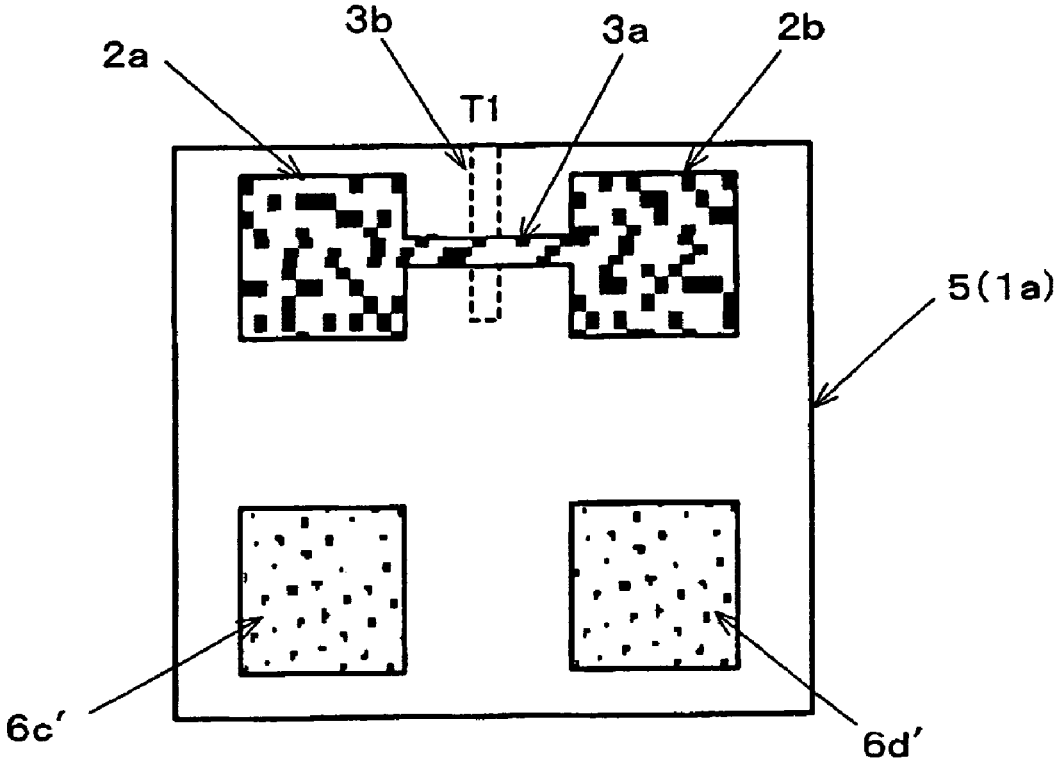
FIG. 5 is a plan view illustrating an intermediate layer of another basic unit in the planar array antenna according to the first embodiment.

FIG. 5 illustrates a basic unit shown in FIGS. 4A to 4C in which the position of feeding end T1 locates on the upper side of the basic unit. In this case, slot line 3*b* does not pass through the region between passive element pairs 66*c*, 66*d*.

Since the basic unit is constructed in this way, as with the case of the conventional planar array antenna, the high frequency power traveling on slot line 3*b* from feeding end T1 branches in opposite phase in the left and right directions at the midpoint of microstrip line 3*a*, and is supplied to powered antenna elements 2*a*, 2*b*. As a result, powered antenna elements 1*a*, 2*b* are excited by the electric fields in the same direction and emit electromagnetic waves with the same polarization plane. The antenna elements operates in the same way upon receiving the electromagnetic wave.

As described above, powered element pairs 26*a*, 26*b* and passive element pairs 66*c*, 66*d* are adjacently arranged, and the interval between the powered antenna elements and the passive elements in powered element pairs 26*a*, 26*b* is equal to the interval between the adjacent passive elements and the passive elements in passive element pairs 66*c*, 66*d*. As a result, passive elements pairs 66*c*, 66*d* easily pick up the electromagnetic field leaked from powered element pairs 26*a*, 26*b* and both element pairs are easily electromagnetically coupled to each other. Since passive element pairs 66*c*, 66*d* are disposed in the magnetic field plane direction of the electromagnetic wave emitted from powered antenna elements 2*a*, 2*b*, passive element pairs 66*c*, 66*d* are directly electromagnetically coupled to powered antenna elements 2*a*, 2*b* and powered element pairs 26*a*, 26*b*. The passive element pairs are electromagnetically coupled to the powered element pairs more closely than the case in which the passive element pairs are disposed in the oblique direction of the powered element pairs.

In this way, the electromagnetic coupling between powered element pairs 26*a*, 26*b* and passive element pairs 66*c*, 66*d* is enhanced in this basic unit, and passive element pairs 66*c*, 66*d* also emit electromagnetic wave with large electromagnetic field intensity at the antenna frequency. Then the electromagnetic waves from powered element pairs 26*a*, 26*b* and passive element pairs 66*a*, 66*b* are combined and emitted. As a result, a planar array antenna having an antenna gain equivalent to that of a conventional array antenna in which all antenna elements are powered antenna elements is obtained. In this way, according to the present embodiment, it is possible to reduce the number of powered antenna elements to which high frequency power is supplied while improving the antenna gain. Specifically, since a basic unit which is a constitutional unit upon constructing an array antenna is constituted from two sets of powered element pairs 26*a*, 26*b* and two sets of passive element pairs 66*c*, 66*d*, the number of the powered antenna elements which constitutes the basic unit can be reduced by half in comparison with the conventional basic unit of a four-element type.

Further, in the present embodiment, powered antenna elements 2*a*, 2*b* are arranged in the intermediate layer of multilayer substrate 5 and passive elements 6*a*, 6*b* are arranged on the surface of multilayer substrate 5 so that the passive elements oppose to the powered antenna elements. Therefore, the distance between powered antenna elements 2*a*, 2*b* and ground conductor 4 differs from the distance between passive elements 6*a*, 6*b* and ground conductor 4. Further more, first substrate 1*a* and second substrate 1*b* each having a larger dielectric constant than the air are interposed between the powered antenna elements and passive elements, and the ground conductor. As a result, a resonant frequency based on powered antenna elements 2*a*, 2*b* in the intermediate layer and ground conductor 4 differs from a resonant frequency based on passive elements 6*c*, 6*d* on the surface and ground conductor 4, and then the frequency band based on the antenna based on powered antenna elements 2*a*, 2*b* becomes a wideband.

It should be noted that the frequency band of the antenna can be further extended by, for example, making difference between the size of powered antenna elements 2*a*, 2*b* and adjacent passive elements 6*c*' 6*d*' which are arranged on the intermediate layer and the size of passive elements 6*a*, 6*b*, 6*c*, 6*d* which are arranged on the surface. The bandwidth widening of the frequency band by such a technique is applicable to the second and third embodiments described below.

An array antenna which uses the same multilayer substrate 5 and has more elements can be arranged by preparing a plurality of the basic units described above and arranging the basic units in an array. For example, a four-element array antenna unit having four sets of the powered element pairs and four sets of the passive element pairs can be constructed by using two sets of the basic units, and an eight-element array antenna unit having eight sets of the powered element pairs and eight sets of the passive element pairs can be constructed by using two sets of these four-element planar array antenna units. Similarly, with n being an integer larger than or equal to 3, a $2^{n+1}$-element array antenna unit can be constructed by using $2^n$ sets of the basic units.

Figure 6A:
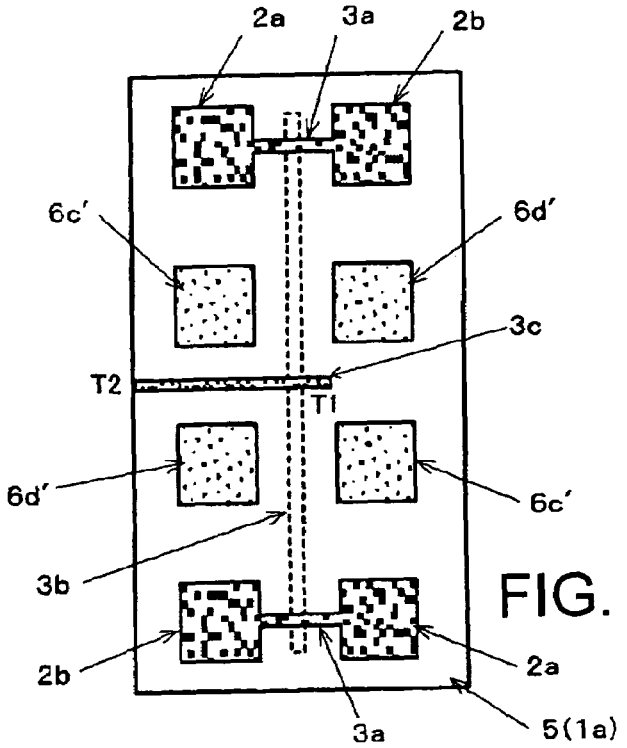
FIG. 6A is a plan view illustrating an intermediate layer in a planar array antenna with four powered antenna elements according to the first embodiment.

FIG. 6A illustrates a four-element array antenna unit thus constructed, especially the intermediate layer thereof. This four-element array antenna unit uses two sets of the basic units shown in FIGS. 1A to 1C. Powered antenna elements 2*a*, 2*b* and adjacent passive elements 6*c*', 6*d*' disposed on the intermediate layer of multilayer substrate 5, that is, on one surface of first substrate 1*a*, are arranged in mirror symmetry or, as shown in the figure, in point symmetry around feeding ends T1 of slot lines 3*b* of the basic units as a center. As a result, slot lines 3*d* provided on the reverse surface of multilayer substrate 5 are mutually connected between the basic units, and both ends of mutually-connected slot line 3*b* traverse the midpoints of microstrip lines 3*a* corresponding to the respective basic units. Microstrip line 3*c* which is a third feeding line and extended from feeding end T2 is provided in the intermediate layer of multilayer substrate 5, and the tip end of microstrip line 3*c* traverses the midpoint of feeding slot line 3*b* and is electromagnetically coupled with slot line 3*b*.

In this four-element array antenna, as described above, the high frequency power supplied to microstrip line 3*c* branches in-phase with the electric field into the upper and lower directions at the midpoint of slot line 3*b*. That is, the high frequency power is subjected to an in-phase branching. The high frequency power then branches in opposite phase with the electric field into the left and right directions at the midpoints of microstrip lines 3*a* of the upper side and lower side in the figure. That is, the high frequency power is subjected to an opposite-phase branching. Then the high frequency power is supplied to powered antenna elements 2*a*, 2*b* which connect to the both ends on microstrip lines 3*a*. As a result, total four pieces of powered antenna elements 2*a*, 2*b* are excited in-phase.

Figure 6B:
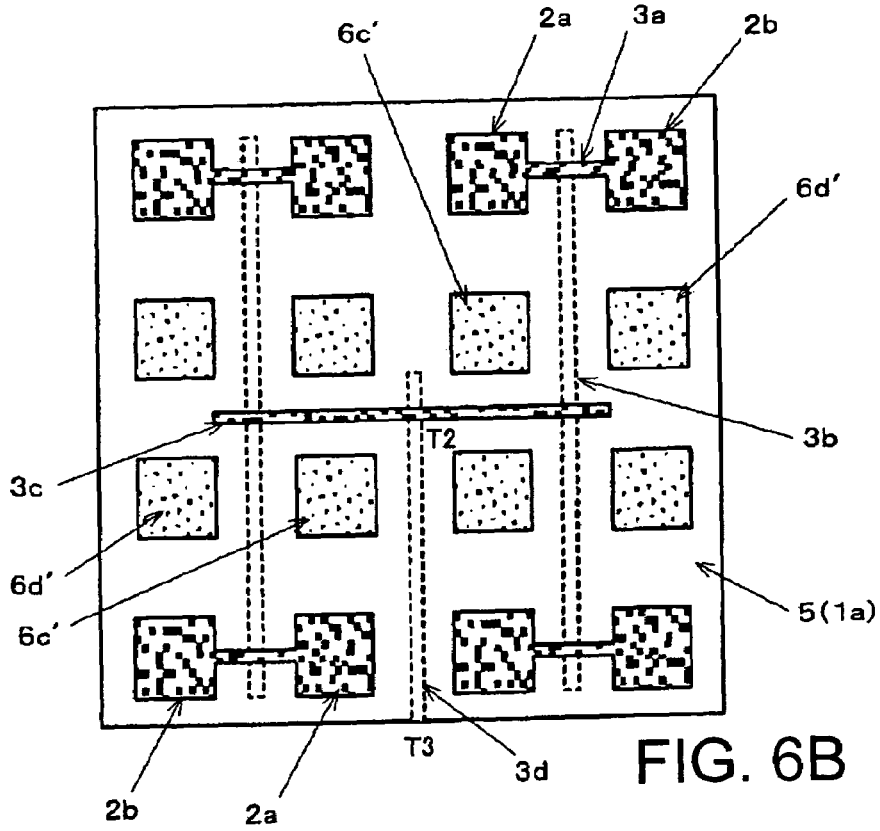
FIG. 6B is a plan view illustrating an intermediate layer in a planar array antenna with eight powered antenna elements according to the first embodiment.

FIG. 6B illustrates an eight-element array antenna unit constructed by using two sets of four-element array antenna units shown in FIG. 6A, especially the intermediate layer thereof. This eight-element array antenna unit uses four sets of the basic units shown in FIGS. 1A to 1C. Specifically, the eight-element array antenna unit is configured so that the two sets of four-element array antenna units are arranged in point symmetry around feeding points T2 of microstrip lines 3*c* as a center as with the above case. As a result, microstrip lines 3*c* provided on the intermediate layer of both four-element array antenna units are mutually connected, and both ends of mutually-connected microstrip line 3*c* traverse the midpoints of slot lines 3*b*, respectively. Further, slot line 3*d* which is a fourth feeding line and extended from feeding end T3 is provided in the reverse surface of multilayer substrate 5, the tip end of slot line 3*d* traversing the midpoint of feeding microstrip line 3*c*.

Similarly, an array antenna having more number of the powered antenna elements can be constructed by combining the array antenna units with the same manner. For example, with n being larger than or equal to 3, a $2^n$-element array antenna units includes $2^{n-1}$ sets of the basic units. An (n+1)-th feeding line is connected to a feeding end of the $2^n$-element array antenna unit. By arranging two sets of these $2^n$-element array antenna units in point symmetry around the feeding point as a center, the (n+1)-th feeding lines of both $2n$-element array antenna units are mutually connected and the both ends of the mutually-connected (n+1)-th feeding line traverse the midpoints of the n-th feeding lines, respectively, and are electromagnetically coupled with the n-th feeding lines. Then, an (n+2)-th feeding line which traverses the midpoint of the (n+1)-th feeding line and electromagnetically couples thereto is provided with one end of the (n+2)-th feeding line being connected to a feeding end. By incrementing n in this way, a planar array antenna having the increased number of the powered antenna elements which uses the same multilayer substrate 5 can be constructed. It should be noted that the (n+2)-th feeding line is a microstrip line when n is an odd number, and the (n+2)-th feeding line is a slot line when n is an even number.

Also in the multi-element array antenna unit thus constructed, passive elements 6*a*, 6*b*, 6*c*, 6*d* are arranged on the surface of multilayer substrate 5 at the respective positions corresponding powered antenna elements 2*a*, 2*b* and adjacent passive elements 6*c*', 6*d*' in the intermediate layer so that powered element pairs 26*a*, 26*b* and passive element pairs 66*c*, 66*d* are formed. The above advantages of the basic unit having powered element pairs 26*a*, 26*b* and passive element pairs 66*c*, 66*d* are exerted in this multi-element array antenna unit. As a result, the antenna gain can be improved and the number of powered antenna elements can be reduced.

Figure 7A:
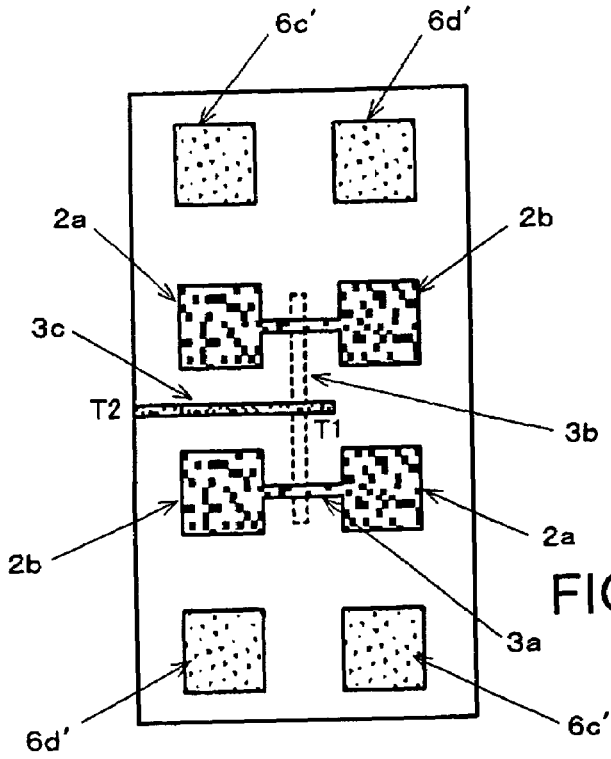
FIG. 7A is a plan view illustrating an intermediate layer in another planar array antenna with four powered antenna elements according to the first embodiment.
Figure 7B:
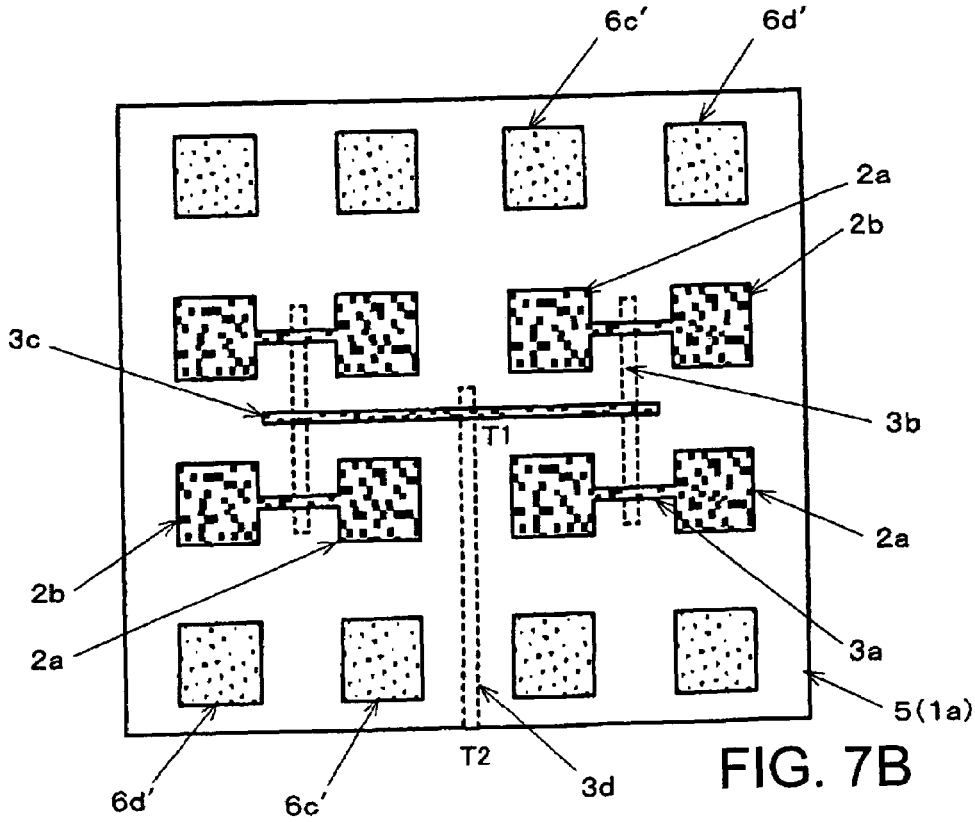
FIG. 7B is a plan view illustrating an intermediate layer in another planar array antenna with eight powered antenna elements according to the first embodiment.

It should be noted that a multi-element array antenna unit can be constructed in the same manner as described above by using basic units having the arrangement shown in FIG. 5. FIG. 7A illustrates a four-element array antenna unit constructed by using the basic units shown in FIG. 5, especially the intermediate layer thereof. FIG. 7B illustrates an eight-element array antenna unit constructed by using the basic units shown in FIG. 5, especially the intermediate layer thereof.

Figure 8A:
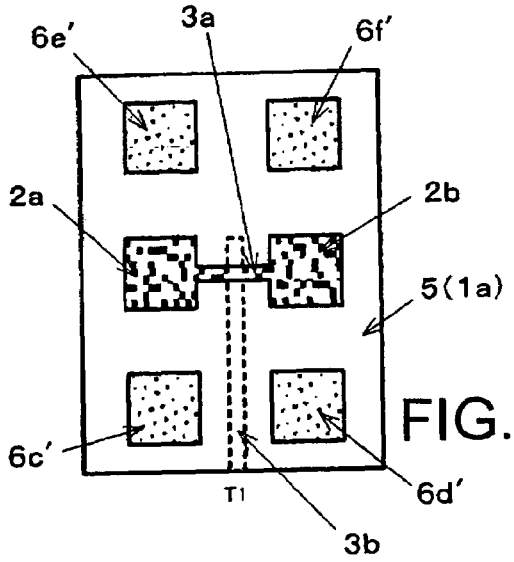
FIG. 8A is a plan view illustrating an intermediate layer of a basic unit which constitutes a planar array antenna according to a second embodiment of the present invention.
Figure 8B:
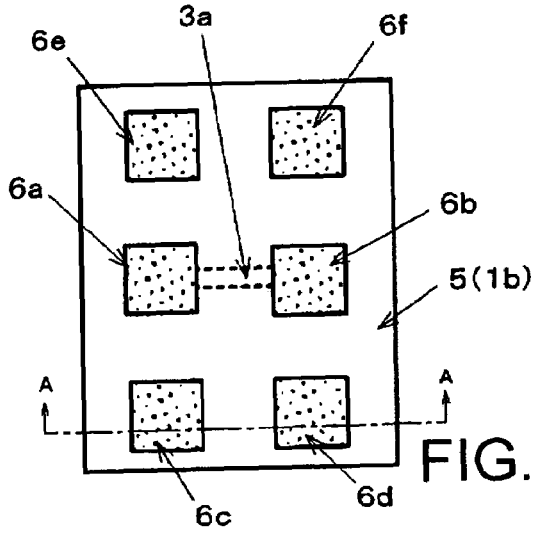
FIG. 8B is a plan view of the basic unit shown in FIG. 8A.
Figure 8C:
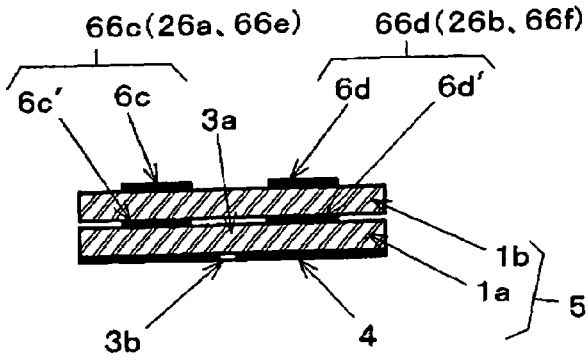
FIG. 8C is a cross-sectional view taken along line A—A of FIG. 8B.

FIGS. 8A to 8C illustrate a microstrip line type planar array antenna according to the second embodiment of the present invention and show the construction of the basic unit used in this planar array antenna. It should be noted that, in FIGS. 8A to 8C, those parts which are identical to those shown in FIGS. 4A to 4C are denoted by identical reference characters and the duplicate explanations thereon are simplified.

Also with the second embodiment, in the basic unit, first and second substrates 1*a*, 1*b* each consisted of a dielectric material are stacked and constitute multilayer substrate 5. Ground conductor 4 is provided on the reverse surface of multilayer substrate 5. On the plane sandwiched by first substrate 1*a* and second substrate 1*b*, that is, an intermediate layer, powered antenna elements 2*a*, 2*b* are arranged at the positions corresponding to the midpoints of the longer sides of a rectangle, respectively, and adjacent passive elements 6*c*', 6*d*', 6*e*', 6*f*' are arranged at the positions corresponding to the four apexes of the rectangle. In other words, among the lattice points arranged in 2×3 in an orthogonal grid, powered antenna elements 2*a*, 2*b* are arranged on the two central lattice points and adjacent passive elements 6*c*', 6*d*', 6*e*', 6*f*' are arranged on the four remaining lattice points. Passive elements 6*a*, 6*b*, 6*c*, 6*d*, 6*e*, 6*f* are disposed on the surface of multilayer substrate 5 so that passive elements 6*a*, 6*b*, 6*c*, 6*d*, 6*e*, 6*f* oppose to powered antenna elements 2*a*, 2*b* and adjacent passive elements 6*c*', 6*d*', 6*e*', 6*f*', respectively. As with the above case, powered antenna elements 2*a*, 2*b* and passive elements 6*a*, 6*b* constitute powered element pairs 26*a*, 26*b*, and adjacent passive elements 6*c*', 6*d*', 6*e*', 6*f*' and passive elements 6*c*, 6*d*, 6*e*, 6*f* constitute passive element pairs 66*c*, 66*d*, 66*e*, 66*f*.

Powered antenna elements 2*a*, 2*b* are connected by microstrip line 3*a* provided in the intermediate layer and fed with the high frequency power through a feeding system having the similar configuration as with the case of the first embodiment.

In such a configuration, passive element pairs 66*c*, 66*d*, 66*e*, 66*f* are disposed adjacent to powered element pairs 26*a*, 26*b* as with the case of the first embodiment, passive element pairs 66*c*, 66*d*, 66*e*, 66*f* easily pick up the leak electromagnetic field from powered element pairs 26*a*, 26*b*, and the powered element pairs and the passive element pairs are electromagnetically coupled to each other easily. Passive element pairs 66*c*, 66*d*, 66*e*, 66*f* are arranged on both sides in the direction of the magnetic field plane emitted from powered antenna elements 2*a*, 2*b*, and directly electromagnetically coupled to powered antenna elements 2*a*, 2*b* and powered element pairs 26*a*, 26*b*.

In this way, the electromagnetic coupling between powered element pairs 26*a*, 26*b* and passive element pairs 66*c*, 66*d*, 66*e*, 66*f* are enhanced in this basic unit, and passive element pairs 66*c*, 66*d*, 66*e*, 66*f* also emit electromagnetic wave with large electromagnetic field intensity at the antenna frequency. Then the electromagnetic waves from powered element pairs 26*a*, 26*b* and passive element pairs 66*a*, 66*b*, 66*e*, 66*f* are combined and emitted. As a result, a planar array antenna having an antenna gain equivalent to that of a conventional array antenna in which all antenna elements are powered antenna elements is obtained. In this way, according to the present embodiment, it is possible to reduce the number of the powered antenna elements to which high frequency power is supplied while improving the antenna gain. Specifically, since a basic unit which is a constitutional unit upon constructing an array antenna is constituted from two sets of powered element pairs 26*a*, 26*b* and four sets of passive element pairs 66*c*, 66*d*, 66*e*, 66*f*, the number of the powered antenna elements which constitutes the basic unit can be reduced by half in comparison with the conventional basic unit of a four-element type.

It should be noted that, in the present embodiment, since the passive element pairs are arranged on both sides of the magnetic field plane direction of the electromagnetic wave emitted from the powered antenna element, the intensity of the emitted electromagnetic wave is enhanced in comparison with the case of the first embodiment.

Figure 9A:
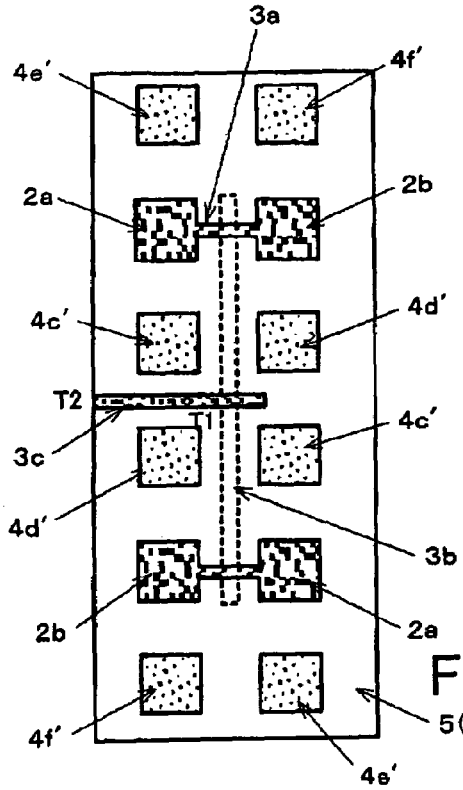
FIG. 9A is a plan view illustrating an intermediate layer in a planar array antenna with four powered antenna elements according to the second embodiment.
Figure 9B:
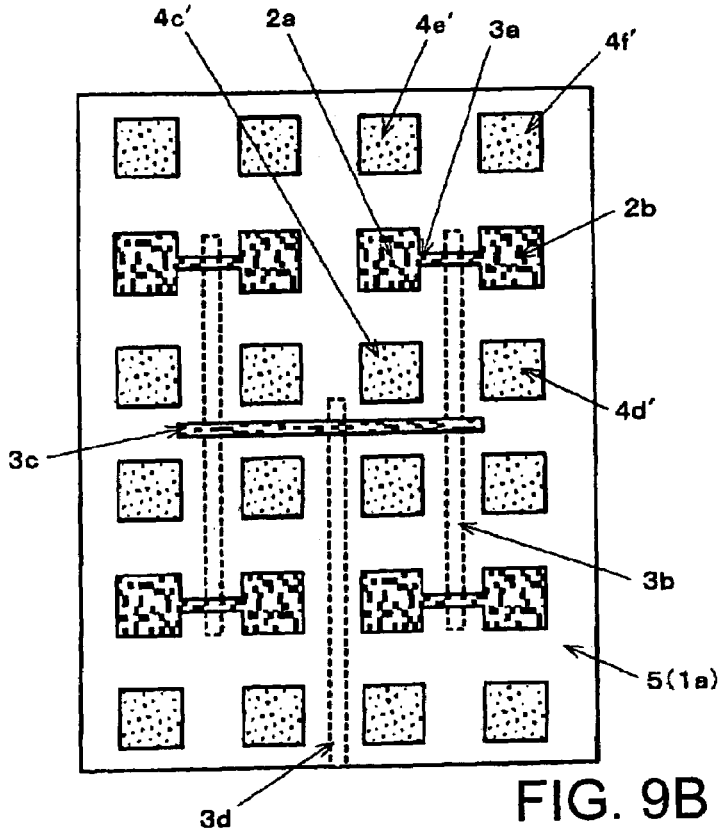
FIG. 9B is a plan view illustrating an intermediate layer in a planar array antenna with eight powered antenna elements according to the second embodiment.

Also in the second embodiment, an array antenna which uses the same multilayer substrate 5 and has more elements can be arranged by preparing a plurality of the basic units described above and arranging the basic units in an array. For example, a four-element array antenna unit having four sets of the powered element pairs and four sets of the passive element pairs can be constructed by using two sets of the basic units and arranging the basic units in point symmetry around feeding end T1 as a center, and an eight-element array antenna unit having eight sets of the powered element pairs and eight sets of the passive element pairs can be constructed by using two sets of this four-element planar array antenna units. Similarly, with n being an integer larger than or equal to 3, a $2^{n+1}$-element array antenna unit can be constructed by using $2^n$ sets of the basic units. FIG. 9A illustrates a four-element array antenna unit constructed as described above, especially the intermediate layer thereof, and FIG. 9B illustrates an eight-element array antenna unit, especially the intermediate layer thereof. Since array antenna units shown in FIGS. 9A and 9B can be constructed in the same manner as the array antenna units shown in FIGS. 6A and 6B, the duplicate explanation is not repeated here.

Figure 10A:
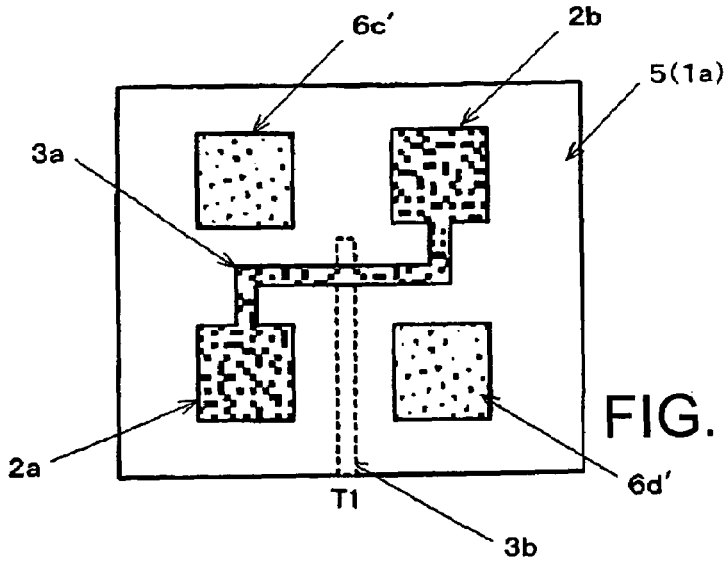
FIG. 10A is a plan view illustrating an intermediate layer of a basic unit which constitutes a planar array antenna according to a third embodiment of the present invention.
Figure 10B:
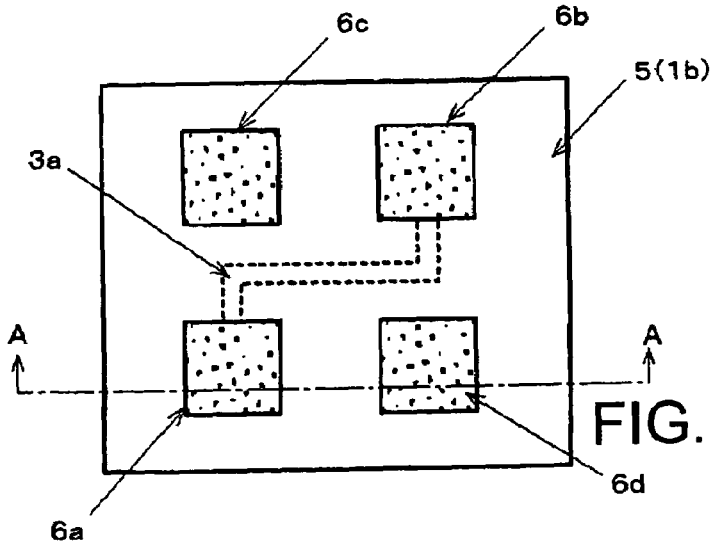
FIG. 10B is a plan view of the basic unit shown in FIG. 10A.
Figure 10C:
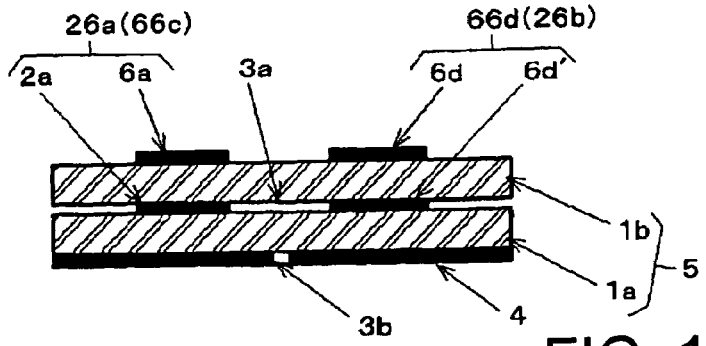
FIG. 10C is a cross-sectional view taken along line A—A of FIG. 10B.

FIGS. 10A to 10C illustrate a microstrip line type planar array antenna according to the third embodiment of the present invention and show the construction of the basic unit used in this planar array antenna. It should be noted that, in FIGS. 10A to 10C, those parts which are identical to those shown in FIGS. 4A to 4C are denoted by identical reference characters and the duplicate explanations thereon are simplified.

Also with the third embodiment, in the basic unit, first and second substrates 1*a*, 1*b* each consisted of a dielectric material are stacked and constitute multilayer substrate 5. Ground conductor 4 is provided on the reverse surface of multilayer substrate 5. On the plane sandwiched by first substrate 1*a* and second substrate 1*b*, that is, an intermediate layer, powered antenna elements 2*a*, 2*b* are arranged at the positions corresponding to both ends of a diagonal of a regular square or a rectangle, respectively, and adjacent passive elements 6*c*', 6*d*' are arranged at the positions corresponding to both ends of the other diagonal. Passive elements 6*a*, 6*b*, 6*c*, 6*d* are disposed on the surface of multilayer substrate 5 so that passive elements 6*a*, 6*b*, 6*c*, 6*d* oppose to powered antenna elements 2*a*, 2*b* and adjacent passive elements 6*c*', 6*d*', respectively. As with the above case, powered antenna elements 2*a*, 2*b* and passive elements 6*a*, 6*b* constitute powered element pairs 26*a*, 26*b*, and adjacent passive elements 6*c*', 6*d*' and passive elements 6*c*, 6*d*, constitute passive element pairs 66*c*, 66*d*.

Powered antenna elements are connected through microstrip line 3*a* formed in a crank shape in the intermediate layer 5 of multilayer substrate 5 and fed with the high frequency power through a feeding system having the similar configuration as with the case of the first embodiment.

In such a configuration, passive element pairs 66*c*, 66*d* are disposed adjacent to powered element pairs 26*a*, 26*b* as with the case of the first and second embodiments, passive element pairs 66*c*, 66*d* easily pick up the leak electromagnetic field from powered element pairs 26*a*, 26*b*, and the powered element pairs and the passive element pairs are electromagnetically coupled to each other easily. Passive element pairs 66*c*, 66*d* are arranged in both of the electric field plane direction and magnetic field plane direction of the electromagnetic wave emitted from powered antenna elements 2*a*, 2*b*, and directly electromagnetically coupled to powered antenna elements 2*a*, 2*b* and powered element pairs 26*a*, 26*b*. In this case, since the passive element pairs are directly electromagnetically coupled to the powered element pairs in both of the horizontal direction and vertical direction in the figure, the degree of coupling between the powered element pairs and the passive element pairs is further enhanced in comparison with the cases of the above first and second embodiments.

In this way, the electromagnetic coupling between powered element pairs 26*a*, 26*b* and passive element pairs 66*c*, 66*d* is enhanced in this basic unit, and passive element pairs 66*c*, 66*d* also emit electromagnetic wave with large electromagnetic field intensity at the antenna frequency. Then the electromagnetic waves from powered element pairs 26*a*, 26*b* and passive element pairs 66*a*, 66*b* are combined and emitted. As a result, a planar array antenna having an antenna gain equivalent to that of a conventional array antenna in which all antenna elements are powered antenna elements is obtained. In this way, according to the present embodiment, it is possible to reduce the number of the powered antenna elements to which high frequency power is supplied while improving the antenna gain. Specifically, since a basic unit which is a constitutional unit upon constructing an array antenna is constituted from two sets of powered element pairs 26*a*, 26*b* and two sets of passive element pairs 66*c*, 66*d*, the number of the powered antenna elements which constitutes the basic unit can be reduced by half in comparison with the conventional basic unit of a four-element type.

Figure 11A:
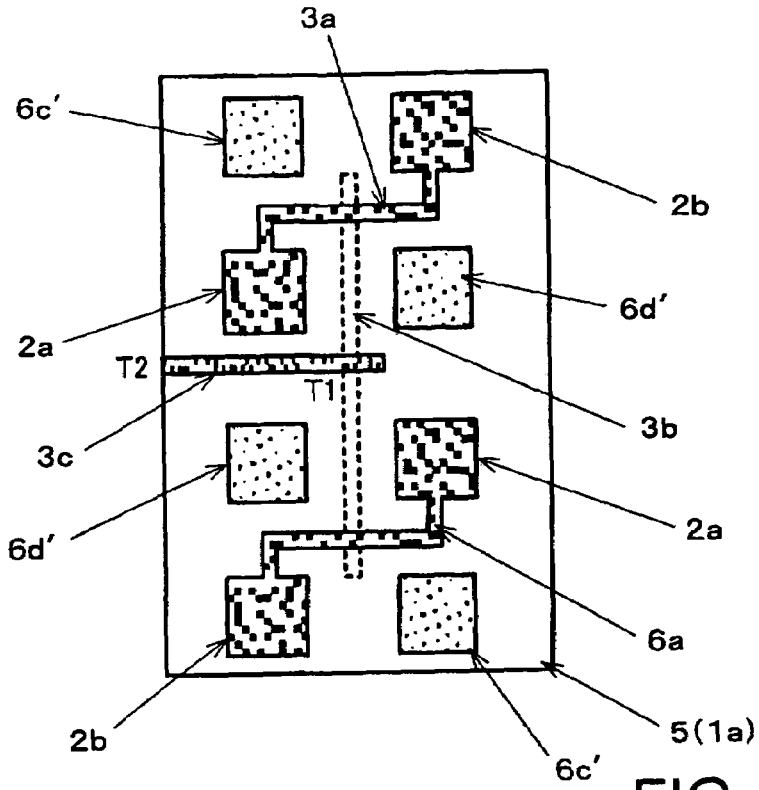
FIG. 11A is a plan view illustrating an intermediate layer in a planar array antenna with four powered antenna elements according to the third embodiment.
Figure 11B:
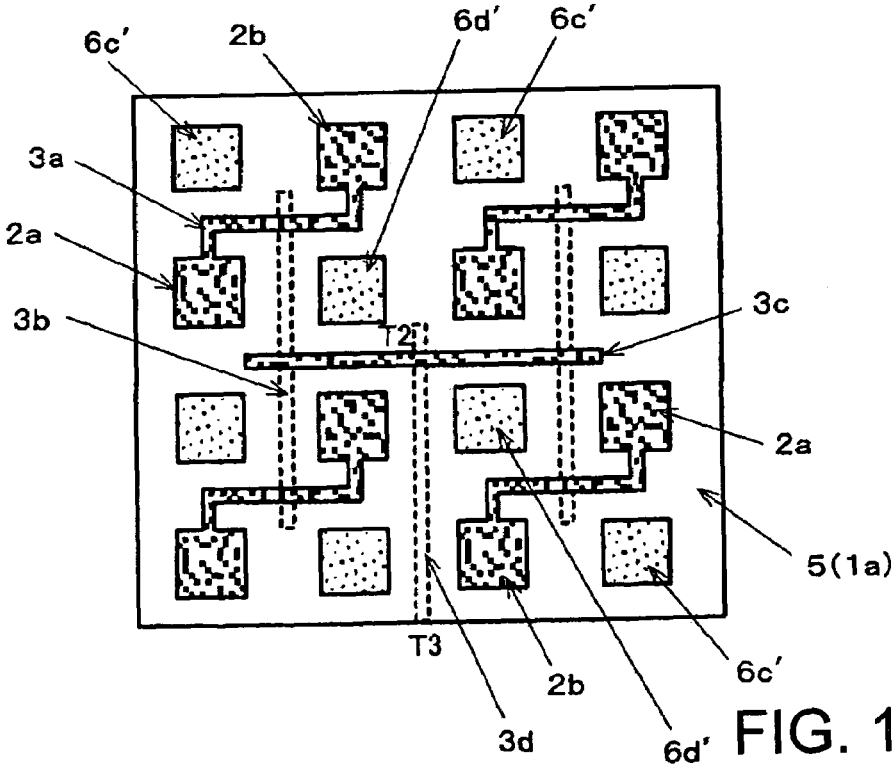
FIG. 11B is a plan view illustrating an intermediate layer in a planar array antenna with eight powered antenna elements according to the third embodiment.

Also in the third embodiment, an array antenna which uses the same multilayer substrate 5 and has more elements can be arranged by preparing a plurality of the basic units described above and arranging the basic units in an array. For example, a four-element array antenna unit having four sets of the powered element pairs and four sets of the passive element pairs can be constructed by using two sets of the basic units and arranging the basic units in point symmetry around feeding end T1 as a center, and an eight-element array antenna unit having eight sets of the powered element pairs and eight sets of the passive element pairs can be constructed by using two sets of these four-element planar array antenna units. Similarly, with n being an integer larger than or equal to 3, a $2^{n+1}$-element array antenna unit can be constructed by using $2^n$ sets of the basic units. FIG. 11A illustrates a four-element array antenna unit constructed as described above, especially the intermediate layer thereof, and FIG. 11B illustrates an eight-element array antenna unit, especially the intermediate layer thereof. Since array antenna units shown in FIGS. 11A and 11B can be constructed in the same manner as the array antenna units shown in FIGS. 6A and 6B, the duplicate explanation is not repeated here.

It should be noted that, in the case of the basic unit according to the third embodiment shown in FIGS. 10A to 10C, two powered element 2*a*, 2*b* disposed in an oblique direction are mutually connected by microstrip line 3*a*, which is the first feeding line, in the intermediate layer of multilayer substrate 5. In this case, microstrip line is not straight but has folded portions and the folded portions are located near powered antenna elements 2*a*, 2*b*. Electromagnetic wave of a cross-polarization is emitted from the folded portion of microstrip line 3*a*, and the cross-polarization component functions as a noise component to, for example, the electromagnetic wave component of vertical polarization which is emitted from each of powered antenna elements 2*a*, 2*b* by the feeding from the vertical direction.

Figure 12A:
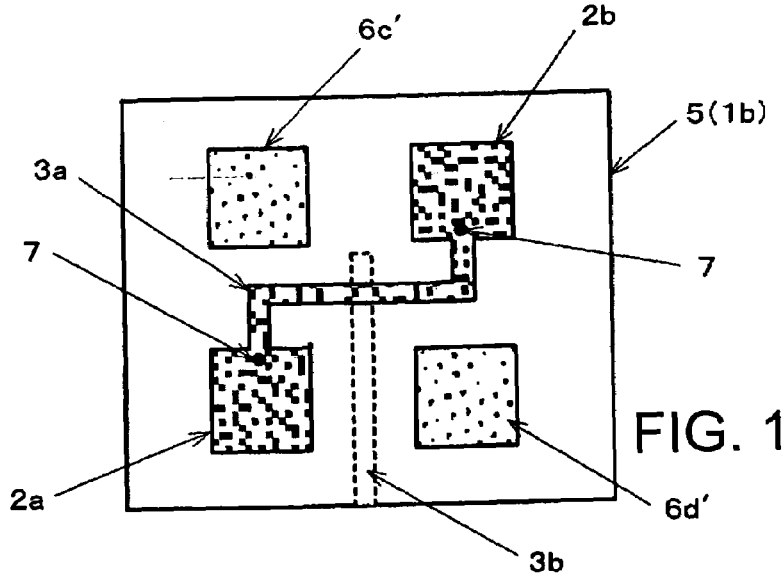
FIG. 12A is a plan view illustrating a second intermediate layer of another basic unit in a planar array antenna according to the third embodiment.
Figure 12B:
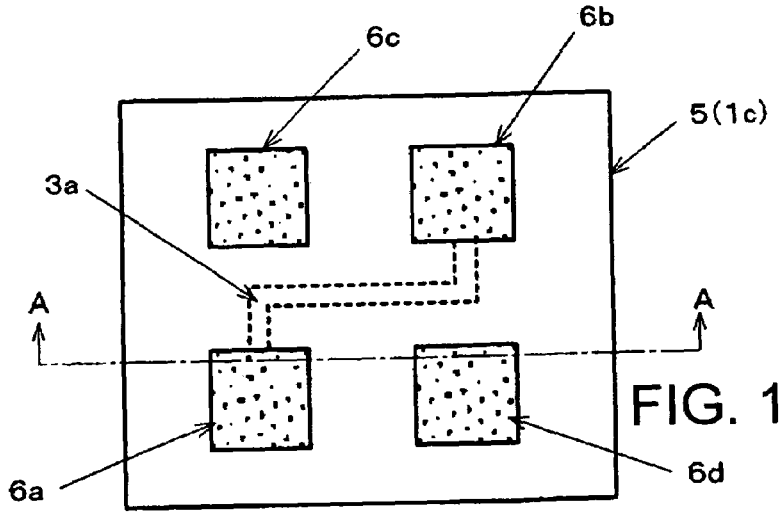
FIG. 12B is a plan view of the basic unit shown in FIG. 12A.
Figure 12C:
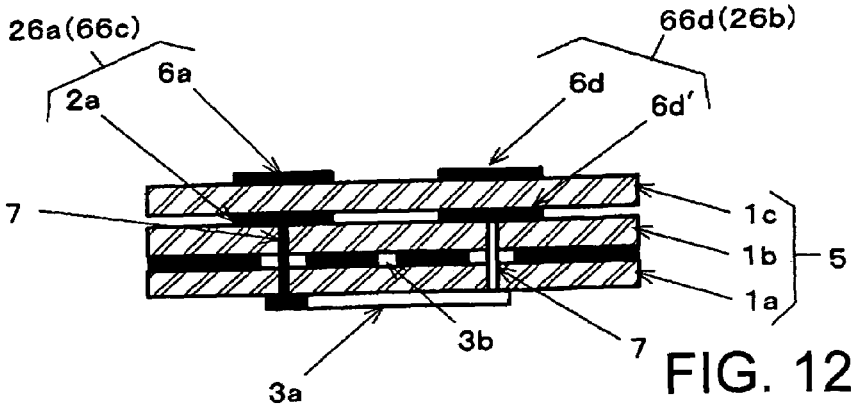
FIG. 12C is a cross-sectional view taken along line A—A of FIG. 12B.

A basic unit in which emission of the cross-polarization component is suppressed is shown in FIGS. 12A to 12C. In the basic unit shown in FIGS. 12A to 12C, multilayer substrate 5 is constructed by stacking first substrate 1*a*, second substrate 1*b* and third substrate 1*c*. With the joining plane between first substrate 1*a* and second substrate 1*b* taken as a first intermediate layer and the joining plane between second substrate 1*b* and third substrate 1*c* taken as a second intermediate layer, powered antenna elements 2*a*, 2*b* and adjacent passive elements 6*c*', 6*d*' are arranged in the second intermediate layer, and passive elements 6*a*, 6*b*, 6*c*, 6*d* are arranged on the surface of multilayer substrate 5, that is, the surface of third substrate 1*c*. Ground conductor 4 in which slot line 3*b* as a second feeding line is arranged is disposed in the first intermediate layer. Microstrip line 3*a* formed in a crank shape, which is a first feeding line, is disposed on the reverse surface of multilayer substrate 5. Microstrip line 3*a* and powered antenna elements 2*a*, 2*b* are connected through via-holes 7. In this configuration, the electromagnetic wave emitted from the folded portion of microstrip line 3*a* is blocked by ground conductor 4 arranged in the first intermediate layer. Powered antenna elements 2*a*, 2*b* can be fed with the high frequency power in only the vertical direction from the vertically extending portion in the figure of microstrip line 3*a*. Consequently, the vertical polarization in which the noise component due to the cross-polarization component is suppressed can be radiated by using this basic unit.

Figure 13A:
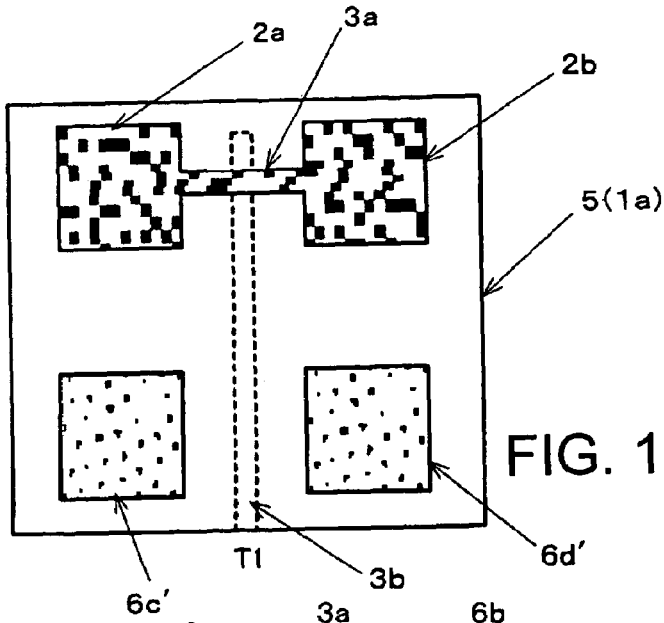
FIG. 13A is a plan view illustrating an intermediate layer of a basic unit which constitutes a planar array antenna according to another embodiment of the present invention.
Figure 13B:
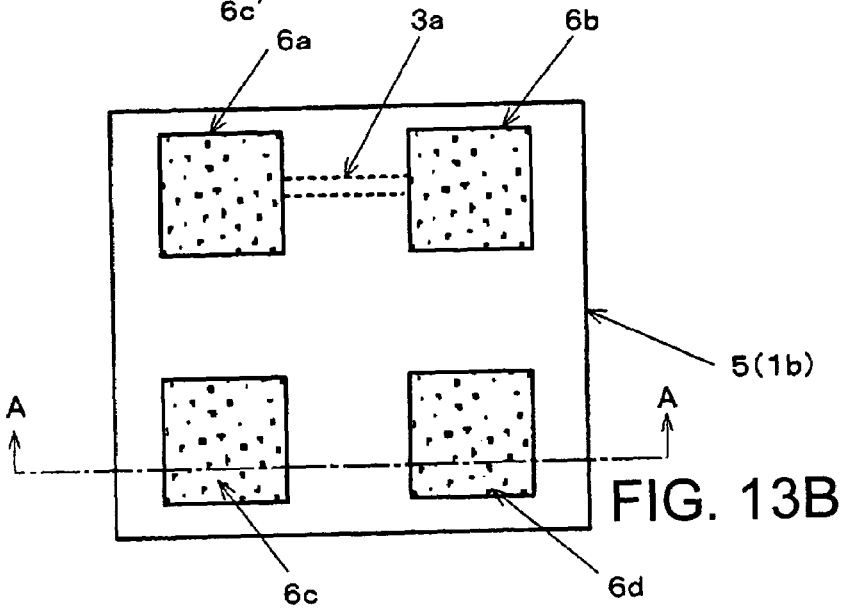
FIG. 13B is a plan view of the basic unit shown in FIG. 13A.
Figure 13C:
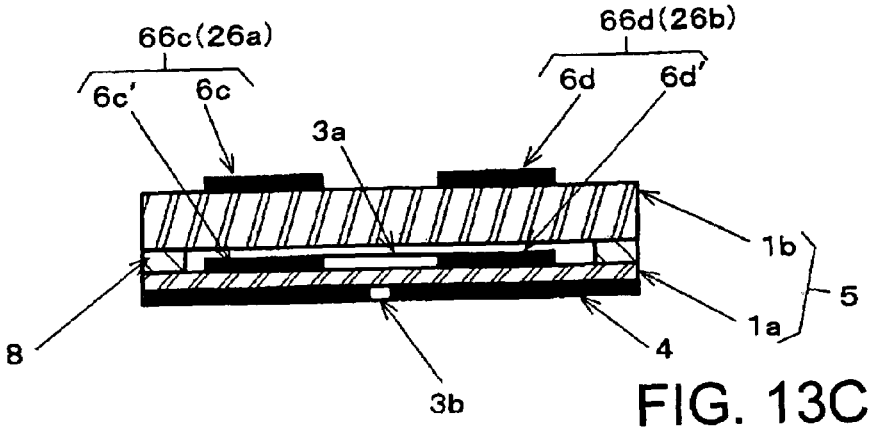
FIG. 13C is a cross-sectional view taken along line A—A of FIG. 13B.

While first substrate 1*a* and second substrate 1*b* are stacked to form multilayer substrate 5 in the above-described embodiments, a configuration in which a hollow portion is arranged within multilayer substrate 5 is possible. A basic unit shown in FIGS. 13A to 13C is one similar to that shown in FIGS. 4A to 4C, but is configured that a spacing is formed between first substrate 1A and second substrate 1B by interposing spacer 8 so that a hollow portion is formed at the position of the intermediate layer. In this case, powered antenna elements 2*a*, 2*b* and adjacent passive elements 6*c*', 6*d*' are formed on the principal surface of first substrate 1*a*. Passive elements 6*a*, 6*b*, 6*c*, 6*d* are formed on the outer surface of second substrate 1*b*. In this case, with the wavelength corresponding to the antenna frequency taken as λ, distance from powered antenna elements 2*a*, 2*b* and adjacent passive elements 6*c*', 6*d*' to passive elements 6*a*, 6*b*, 6*c*, 6*d* is set to a length of approximately λ/2.

In this configuration, in this case, in addition to the first resonant frequency determined from the distance between powered antenna elements 2*a*, 2*b* and passive elements 6*a*, 6*d*, a second resonant frequency which is determined by the distance from powered antenna elements 2*a*, 2*b* to the inner surface of second substrate 1*b*, that is, the surface oriented to the hollow portion appears. Therefore, for example, it is possible to extend the frequency band of the antenna by using the second resonant frequency as well as it is possible to increase the antenna gain by setting the first resonant frequency to the antenna frequency.

While the powered antenna elements, adjacent passive elements, and passive elements have been described as being regular square in shape, the shape may be rectangular, and further, it may be circular including an elliptical shape. One can select the shape of these elements according to the requirement. The configuration of the planar array antenna such as the mutual distance between powered antenna elements 2*a*, 2*b*, and the distance between the basic units in the case of constructing a multi-element array antenna unit may be arbitrarily determined based on specification according to the directivity characteristic, band width, antenna gain, application of the antenna, or the like.

What is claimed is:

1. A planar array antenna comprising:

a substrate made of a dielectric material;

a powered antenna element of a microstrip-line type disposed on one principal surface of said substrate;

a ground conductor disposed on the other principal surface of said substrate;

a feeding system for feeding high frequency power to the powered antenna element;

an adjacent passive element disposed on the one principal surface of said substrate;

a first passive element disposed ahead of said powered antenna element with space therebetween; and a second passive element disposed ahead of said adjacent passive element with space therebetween;

wherein said powered antenna element and a first passive element corresponding to the powered antenna element constitute a powered element pair, said adjacent passive element and a second passive element corresponding to the adjacent passive element constitute a passive element pair, and said passive element pair is disposed so that it adjoins said powered element pair in an electric field direction or a magnetic field direction of radio wave emitted from said powered antenna element.

2. The planar array antenna according to claim 1, wherein a spacing between said powered antenna element and said first passive element is identical to a spacing between said adjacent passive element and said second passive element.

3. The planar array antenna according to claim 2, wherein said first passive element and said second passive element are disposed on a surface of a second substrate which is arranged on said one principal surface.

4. The planar array antenna according to claim 2, wherein two sets of said powered element pairs and a plurality of sets of said passive element pairs constitute a basic unit;

said feeding system comprises a first feeding line consisting of a microstrip-line which connects at both ends thereof to two powered antenna elements in the same basic unit, and a second feeding line consisting of a slot line formed in said ground conductor, said second feeding line traversing a midpoint of said first feeding line and electromagnetically coupled to said first feeding line.

5. The planar array antenna according to claim 4, comprising a plurality of pieces of said basic units, wherein said feeding system is constructed by combining an opposite-phase branching to a microstrip line from a slot line and an in-phase branching to a slot lint from a microstrip line, and the powered antenna elements of each of the basic units is fed from a single feeding end.

6. The planar array antenna according to claim 4, constructed as a four-element array antenna unit, comprising:

two pieces of said basic units, said two pieces of the basic units being arranged in point symmetry or mirror symmetry around a feeding end of said second feeding line as a center; said second feeding line of each of said basic units being connected in common; and a third feeding line consisting of a microstrip line, which traverses a midpoint of the common-connected second feeding line and is electromagnetically coupled to the common-connected second feeding line.

7. A planar array antenna which uses the four-element array antenna unit according to claim 6 as a base and is constructed as $2^{n+1}$-element array antenna unit, comprising:

two pieces of $2^n$-array antenna units where n is an integer greater than or equal to 2, said two pieces of the $2^n$-array antenna units being arranged in point symmetry or mirror symmetry around a feeding end of the (n+1)-th feeding line as a center; said (n+1)-th feeding line of each of said $2^n$-array antenna units being connected in common; and an (n+2)-th feeding line which traverses a midpoint of the common-connected (n+1)-th feeding line and is electromagnetically coupled to the common-connected (n+1)-th feeding line, wherein, n being an integer, if n is an odd number the (n+2)-th feeding line is a microstrip line, and if n is an even number the (n+2)-th feeding line is a slot line.

8. The planar array antenna according to claim 4, wherein said basic unit comprises two sets of said passive element pairs, in said basic unit, the powered element pairs are disposed on positions corresponding to both ends of one side of a regular square or rectangle, said passive element pairs are disposed on positions corresponding to both ends of a side which opposes to said one side.

9. The planar array antenna according to claim 4, wherein said basic unit comprises four sets of said passive element pairs, in said basic unit, the powered element pairs are disposed on positions corresponding to midpoints of longer sides of a rectangle, said passive element pairs are disposed on positions corresponding to apexes of said rectangle.

10. The planar array antenna according to claim 4, wherein said basic unit comprises two sets of said passive element pairs, in said basic unit, the powered element pairs are disposed on positions corresponding to both ends of one diagonal of a regular square or rectangle, said passive element pairs are disposed on positions corresponding to both ends of the other diagonal.

11. The planar array antenna according to claim 10, comprising an auxiliary substrate which is formed on said ground conductor and consists of a dielectric material, wherein said first feeding line is formed as a cranked microstrip line on said auxiliary substrate, and both ends of said first feeding line are connected to said powered antenna elements through via-holes, respectively.

12. The planar array antenna according to claim 4, wherein said first passive element and said second passive element are disposed on a surface of a second substrate which is laminated on said one principal surface.

13. The planar array antenna according to claim 4, wherein said first passive element and said second passive element are disposed on an outer surface of a second substrate which is disposed on said one principal surface via a hollow portion.

14. The planar array antenna according to claim 12, wherein said plurality of basic units share said first substrate and said second substrate.

15. The planar array antenna according to claim 13, wherein said plurality of basic units share said first substrate and said second substrate.

* * * * *